US006109441A

United States Patent [19]

Anderson

[11] Patent Number: 6,109,441

[45] Date of Patent: Aug. 29, 2000

[54] URINAL

[75] Inventor: Robert S. Anderson, Scottsdale, Ariz.

[73] Assignee: Premium Plastics, Inc.

[21] Appl. No.: 09/472,266

[22] Filed: Dec. 23, 1999

Related U.S. Application Data

[63] Continuation-in-part of application No. 29/113,932, Nov. 15, 1999.

[51] Int. Cl.[7] ..... B65D 85/00

[52] U.S. Cl. ..... 206/526; 206/581; 206/438; 4/144.1

[58] Field of Search ..... 4/144.1, 144.2, 4/144.3; 206/438, 526, 581

[56] References Cited

U.S. PATENT DOCUMENTS

| | | | |
|---|---|---|---|
| D. 297,462 | 8/1988 | Meunchen . | |
| D. 304,373 | 10/1989 | Floyd . | |
| D. 372,075 | 7/1996 | Baxley . | |
| D. 390,657 | 2/1998 | Asta . | |
| 2,855,607 | 10/1958 | Sullivan | 4/144.2 |
| 3,479,671 | 11/1969 | Beich . | |
| 3,625,654 | 12/1971 | Van Duyne | 4/144.1 |
| 3,727,244 | 4/1973 | Collins . | |
| 3,776,235 | 12/1973 | Ratcliffe et al. . | |
| 4,194,508 | 3/1980 | Anderson . | |
| 4,309,779 | 1/1982 | Knight . | |
| 4,610,675 | 9/1986 | Triunfol . | |
| 4,681,572 | 7/1987 | Tokarz et al. . | |
| 4,911,698 | 3/1990 | Wapner . | |
| 5,343,570 | 9/1994 | Arpaia et al. . | |
| 5,387,205 | 2/1995 | Cummins . | |

*Primary Examiner*—Charles R. Eloshway
*Attorney, Agent, or Firm*—Rockey, Milnamow & Katz, Ltd.

[57] ABSTRACT

Two similar urinals are nested in a package so that both urinals occupy a volume less than twice the volume occupied by one of the urinals. Each urinal has a body having a lower wall, an upper mouth, a front wall having an upper portion and a lower portion, and a back wall defining a tangent plane. The upper mouth has a margin defining a plane meeting the tangent plane defined by the back wall at an acute angle. Each urinal fits between an upper plane and a lower plane, each meeting the plane tangent defined by the back wall of said urinal at a right angle. Each urinal has a handle unitary with the body of said urinal and projecting from the body of said urinal, near the upper mouth of the body of said urinal, toward the lower portion of the front wall of the body of said urinal, so as to define a gap between the handle and the upper portion of the front wall of said urinal. The lower portion of the front wall of each urinal defines a tangent plane meeting the tangent plane defined by the back wall of said urinal at an acute angle and being substantially parallel to the plane defined by the margin of the mouth of said urinal. The similar urinals are nested in the package so that each urinal is inverted in relation to the other urinal, so that the handle of each urinal fits into the gap defined between the handle of the other urinal and the upper portion of the front wall of the other urinal, and so that the nested urinals approximate and fit between coincident planes.

3 Claims, 1 Drawing Sheet

URINAL

CROSS-REFERENCE TO RELATED APPLICATION

This application is a continuation-in-part of U.S. Design patent application Ser. No. 29/113,932, which was filed on Nov. 15, 1999, and the disclosure of which is incorporated herein by reference.

TECHNICAL FIELD OF THE INVENTION

This invention pertains to a urinal, which has a body and a unitary handle. The urinal may be blow-molded from a suitable polymer, such as polyethylene. The urinal is nestable with a similar urinal, in a package, so that a handle of each urinal fits into a gap defined by the handle and a portion of the body of the other urinal.

BACKGROUND OF THE INVENTION

A urinal of a type in widespread use is blow-molded from a suitable polymer, such as polyethylene, so as to have a body having a lower wall, an upper mouth, and front, side, and back walls and so as to have a unitary handle projecting from the body, near the upper mouth, toward a lower portion of the front wall, whereby a gap is defined between the handle and an upper portion of the front wall. Commonly, a urinal of the type noted above is provided with a cap, which is adapted to be snap-fitted around a margin of the upper mouth and which is attached to the handle, where the handle meets the body, via a tether that is unitary with the cap.

As known heretofore, a urinal of the type noted above is too bulky to be compactly nested with a similar urinal, as for packing in a carton made of corrugated paperboard or otherwise and for shipping. Therefore, although they are not heavy, urinals of the type noted above can be rather expensive to pack and to ship. A need has been ascertained, to which this invention is addressed, for such a urinal that can be compactly nested with a similar urinal.

SUMMARY OF THE INVENTION

This invention provides a urinal of the type noted above, which can be compactly nested with a similar urinal, as for packing in a carton of corrugated paperboard or otherwise and for shipping. The urinal has a body having a lower wall, an upper mouth, a front wall having an upper portion and a lower portion, and a back wall defining a tangent plane The upper mouth has a circumferential margin defining a plane meeting the tangent plane defined by the back wall at an acute angle The urinal fits between an upper plane and a lower plane. Each of the upper and lower planes meets the plane defined by the back wall of said urinal at a right angle.

The urinal has a handle that is unitary with the body of the urinal. The handle projects from the body of the urinal, near the upper mouth of the body of said urinal, toward the lower portion of the front wall of the body of the urinal, so as to define a gap between the handle and the upper portion of the front wall of the urinal. The urinal is nestable with a similar urinal in a package so that each urinal is inverted in relation to the other urinal and so that the handle of each urinal fits into the gap defined between the handle of the other urinal and the upper portion of the front wall of the other urinal.

Preferably, the urinal is nestable with the similar urinal in the package so that the nested urinals approximate and fit between coincident upper and lower planes. Preferably, the lower portion of the front wall of the urinal defines a tangent plane meeting the tangent plane defined by the back wall of the urinal at an acute angle, whereupon the tangent plane defined by the back wall may be substantially parallel to the tangent plane defined by the margin of the mouth of the urinal.

These and other objects, features, and advantages of this invention are evident from the following description of a preferred embodiment of this invention, with reference to the accompanying drawings.

DETAILED DESCRIPTION OF THE PREFERRED EMBODIMENT

Figure 1:
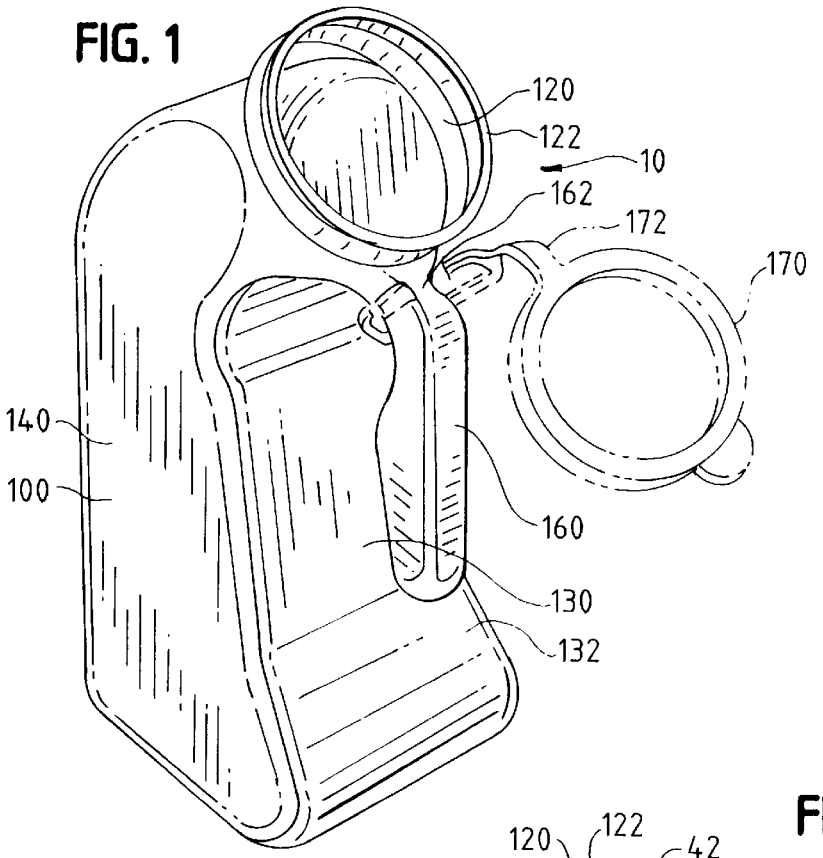
FIG. 1 is a perspective view of a urinal constituting a preferred embodiment of this invention. A cap, which may be optionally provided for the urinal, is shown in broken lines.
Figure 2:
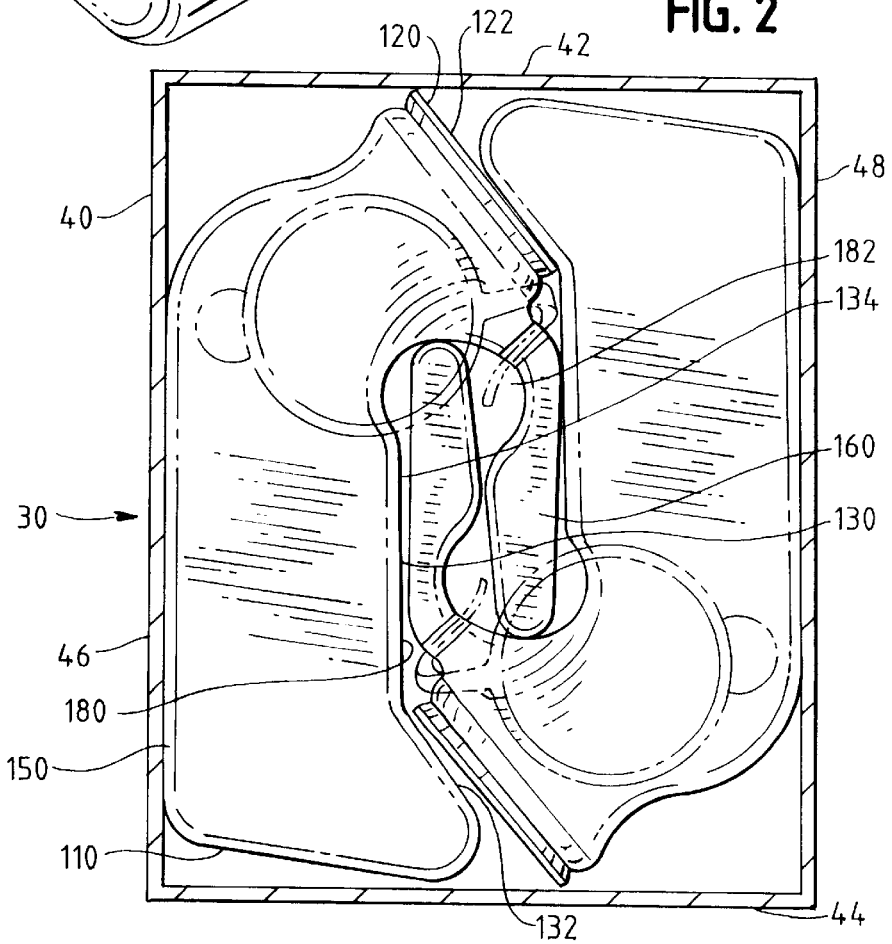
FIG. 2 is an elevational view of the same urinal and a similar urinal in a package, which comprises a carton of corrugated paperboard and in which the urinals are nested compactly, as contemplated by this invention.

A urinal 10, which is illustrated in FIG. 1, constitutes a preferred embodiment of this invention. In U.S. Design patent application Ser. No. 29/113,932, supra, the urinal 10 is illustrated in several other views. As illustrated in FIG. 2, two such urinals 10 can be compactly nested in a package 30, which comprises a carton 40 being made of corrugated paperboard and having an upper wall 42 defining a plane, a lower wall 44 defining a plane, a left wall 46 defining a plane normal to the planes defined by the upper and lower walls 42, 44, and a right wall 48 defining a plane normal to the planes defined by the upper and lower walls 42, 44.

Herein, directional terms including "upper", "lower", "front", and "back" refer to the urinals 10 in a convenient orientation, in which the urinal 10 is illustrated in FIG. 1, and to the carton 40 in a convenient orientation, in which the carton 40 is illustrated in FIG. 2, but are not intended to limit this invention to any particular orientation. In the package 30, however, one urinal 10 is inverted.

The urinal 10 can be blow-molded from a suitable polymer, such as polyethylene, so as to have a body 100 having a lower wall 110, an upper mouth 120 with a circular margin 122, a front wall 130, two side walls 140, and a back wall 150, so as to have curved comers where the respective walls join one another, ans so as to have a unitary handle 160 projecting from the body 100, near the upper mouth 120, toward a lower portion 132 of the front wall 130.

The back wall 150, which may be generally planar, defines a tangent plane. The circular margin 122 of the upper mouth 120 defines a plane, which meets the tangent plane defined by the back wall 150 at an acute angle. The lower portion 132 of the front wall 130 also may be generally planar and defines a tangent plane, which meets the tangent plane defined by the back wall 150 at an acute angle, and which is substantially parallel to the plane defined by the circular margin 122 of the upper mouth 120.

As illustrated in broken lines, a separate cap 170, which is molded from a similar polymer, is adapted to be snap-fitted around the circular margin 122 of the upper mouth 120 and is attached to the handle 160, via a tether 172 unitary with the cap 170, where the handle 160 meets the body 100 at a necked-in portion 162 of the handle 160. Such a cap is conventional and is outside the scope of this invention.

The handle 160 projects from the body 100, as illustrated and as discussed above, so as to define a gap 180 between the handle 160 and an upper portion 134 of the front wall 130. In a region 182 near where the handle 160 meets the body, the gap 180 is widened so as to accommodate a bed rail (not shown) from which the urinal 10 can be conveniently hung in its upright position, in which the urinal 10 is illustrated in FIG. 1.

The urinals 10 are configured, as illustrated, so that the urinals 10 can be compactly nested in the package 30, in which one urinal 10 is upright and the other urinal 10 is inverted. Specifically, the urinals 10 are configured so that the handle 160 of the upright urinal 10 fits into the gap 180 defined by the handle 160 of the inverted urinal 10 and the upper portion 134 of the front wall 130 of the body 100 of the inverted urinal 10, so that the handle 160 of the inverted urinal 10 fits into the gap 180 defined by the handle 160 of the upright urinal 10 and the upper portion 134 of the front wall 130 of the body 100 of the upright urinal 10.

Additionally, the urinals 10 are configured so that the upright urinal 10 approximates and fits between a plane that coincides with the plane defined by the upper wall 42 of the carton 40 and a plane that coincides the plane defined by the lower wall 44 of the carton 40, and so that the inverted urinal 10 approximates and fits between a plane coincides with the plane defined by the lower wall 44 of the carton 40 and a plane that coincides with the plane defined by the upper wall 42 of the carton 40.

What is claimed is:

1. A package comprising, two similar urinals, each urinal having a body having a lower wall, an upper mouth, a front wall having an upper portion and a lower portion, and a back wall defining a tangent plane, which the upper mouth has a margin defining a plane meeting the tangent plane defined by the back wall at an acute angle, each urinal approximating and fitting between upper and lower planes of the carton, each of which upper and lower planes meets the tangent plane defined by the back wall of said urinal at a right angle, wherein each urinal has a handle unitary with the body of said urinal, the handle projecting from the body of said urinal, near the upper mouth of the body of said urinal, toward the lower portion of the front wall of the body of said urinal, so as to define a gap between the handle and the upper portion of the front wall of said urinal, and wherein the urinals are nested in the carton so that one urinal is inverted in relation to the other urinal and so that the handle of each urinal fits into the gap defined between the handle of the other urinal and the upper portion of the front wall of the other urinal.

2. The package of claim 1 wherein the urinals are nested in the carton so as to approximate coincident planes, between which the urinals in the carton fit.

3. The package of claim 2 wherein the tangent plane defined by the lower portion of the front wall of each urinal is substantially parallel to the plane defined by the margin of the upper mouth of said urinal.

* * * * *